US007272949B2

(12) United States Patent
Lee et al.

(10) Patent No.: US 7,272,949 B2
(45) Date of Patent: Sep. 25, 2007

(54) REFRIGERATOR AND AIRFLOW PASSAGE FOR ICE MAKING COMPARTMENT OF THE SAME

(75) Inventors: Myung Ryul Lee, Seongnam-si (KR); Sung Hoon Chung, Seoul (KR); Seong Jae Kim, Ansan-si (KR); Chang Ho Seo, Seoul (KR)

(73) Assignee: LG Electronics Inc., Seoul (KR)

( * ) Notice: Subject to any disclaimer, the term of this patent is extended or adjusted under 35 U.S.C. 154(b) by 43 days.

(21) Appl. No.: 11/129,402

(22) Filed: May 16, 2005

(65) Prior Publication Data

US 2005/0252232 A1 Nov. 17, 2005

(30) Foreign Application Priority Data

May 17, 2004 (KR) ..... 10-2004-0034874

(51) Int. Cl.
*F25C 1/00* (2006.01)

(52) U.S. Cl. ..... 62/344; 454/275

(58) Field of Classification Search ..... 62/344, 62/353; 454/259, 275, 277
See application file for complete search history.

(56) References Cited

U.S. PATENT DOCUMENTS 3,380,370 A * 4/1968 Mack ..... 454/275
4,667,481 A * 5/1987 Watanabe et al. ..... 62/235
4,785,596 A * 11/1988 Wiley et al. ..... 52/198
5,447,470 A * 9/1995 Zaniewski ..... 454/259
5,976,009 A * 11/1999 Achen ..... 454/195
6,148,624 A 11/2000 Bishop et al.
6,945,068 B2 * 9/2005 Kim et al. ..... 62/353
7,076,967 B2 * 7/2006 Lee et al. ..... 62/353

FOREIGN PATENT DOCUMENTS

JP 06-011228 1/1994
WO WO-03/102481 A 12/2003

* cited by examiner

*Primary Examiner*—William E. Tapolcai
(74) *Attorney, Agent, or Firm*—Birch, Stewart, Kolasch & Birch, LLP

(57) ABSTRACT

A refrigerator is provided with an airflow passage for an ice making compartment of the refrigerator. In the refrigerator, a main body has an opened side, and a door selectively closes the opened side of the main body. An ice making compartment is formed in the door, the ice making compartment being insulated from the outside and being kept at a low temperature. A duct is formed in the main body for exchanging cooling air with the ice making compartment, and a cooling air passage is formed at an outer surface of the ice making compartment to connect the duct with the ice making compartment. A switching unit closes the cooling air passage when the door is opened, and opens the cooling air passage when the door is closed. With this arrangement, the cooling air can be sufficiently supplied to the ice making compartment without the penetration of foreign substance.

15 Claims, 13 Drawing Sheets

REFRIGERATOR AND AIRFLOW PASSAGE FOR ICE MAKING COMPARTMENT OF THE SAME

This application claims priority under 35 U.S.C. § 119(a) on Patent Application No. 10-2004-0034874 filed in Korea on May 17, 2004, which is herein incorporated by reference.

BACKGROUND OF THE INVENTION

1. Field of the Invention

The present invention relates to a refrigerator, and more particularly, to a refrigerator and airflow passage for an ice making compartment of the refrigerator, in which a cooling air passage of the ice making compartment is associated with the opening and closing operations of a chilling compartment door to reduce the penetration of foreign substances and airflow loss. In the refrigerator and airflow passage of the present invention, the cooling air passage between the ice making compartment formed in the chilling compartment door and a refrigerator body is selectively opened and closed according to the closing and opening of the chilling compartment door to reduce the penetration of foreign substances and leakage of cooling air, while supplying more cooling air.

2. Description of the Background Art

A refrigerator is an electrical appliance in which a refrigerating cycle of compression, condensation, expansion, and evaporation is repeated using refrigerant to store food at a low temperature. Large refrigerators are becoming common and various types of refrigerators have been developed to satisfy the demands of the user. For example, a top refrigerator type is known in which a refrigeration chamber is located above a freezing chamber, a bottom refrigerator type is known in which a refrigeration chamber is located below a freezing chamber, and a side-by-side type refrigerator is known in which a freezing chamber and a refrigeration chamber are positioned left and right of one another.

The freezing chamber and the refrigeration chamber are separated in from one another in these types of refrigerators. Also, these types of refrigerators provide additional functions as well as basic chilling and freezing functions. For example, an ice making unit provides the functions of freezing water and storing and dispensing of the ice. The ice making unit may be installed in the freezing chamber or in the door of the refrigeration chamber. In a situation where the ice making unit is installed in the refrigeration chamber door, the refrigeration chamber door includes an ice making compartment to accommodate the ice making unit, and cooling air is supplied to the ice making compartment.

To supply cooling air to the ice making compartment, a cooling air inlet hole is defined in the ice making compartment, and a cooling air supply hole is defined in the refrigerator body. The cooling air inlet hole and the cooling air supply hole are interconnected in order to pass the cooling air when the refrigeration chamber door is closed. However, the cooling air inlet hole and the cooling air supply hole are spaced apart from one another when the refrigeration chamber door is opened, thereby permitting the cooling air hole to be exposed to the external environment.

Since the cooling air inlet hole is exposed to the outside when the refrigeration chamber door is opened, foreign substances such as dust can go into the ice making compartment. Also, the inflow of the foreign substances may be increased when the size of the cooling air inlet hole is increased to supply more cooling air to the ice making compartment. Further, although the supply of cooling air to the ice making compartment can be increased by increasing the size of the cooling air inlet hole, such an arrangement causes increased leakage of the cooling air when the refrigeration chamber door is opened, thereby decreasing the efficiency of the ice making compartment.

SUMMARY OF THE INVENTION

Accordingly, the present invention is directed to a refrigerator and an airflow passage for an ice making compartment of the refrigerator that substantially obviates one or more problems due to limitations and disadvantages of the background art.

An object of the present invention is to provide a refrigerator and an airflow passage for an ice making compartment of the refrigerator, in which a cooling air passage of the ice making compartment is selectively opened and closed according to closing and opening movements of a refrigeration chamber door.

Another object of the present invention is to provide a refrigerator and an airflow passage for an ice making compartment of the refrigerator, in which a cooling air passage is associated with opening and closing movements of a refrigeration chamber door to increase the amount of cooling air supplied to the ice making compartment without permitting the penetration of foreign substances into the ice making compartment.

A further another object of the present invention is to provide a refrigerator and an airflow passage for an ice making compartment of the refrigerator, in which a cooling air passage of an ice making compartment is closed when a refrigeration chamber door is opened in order to prevent leakage of cooling air, thereby increasing efficiency of the refrigerator.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a refrigerator including a main body having an opened side, a door selectively closing the opened side of the main body, an ice making compartment formed in the door, the ice making compartment being insulated from the outside and being kept at a low temperature, a duct formed in the main body for exchanging cooling air with the ice making compartment, a cooling air passage formed at an outer surface of the ice making compartment to connect the duct with the ice making compartment, and a switching unit closing the cooling air passage when the door is opened and opening the cooling air passage when the door is closed.

In another aspect of the present invention, there is provided an airflow passage for a refrigerator, including a duct allowing cooling air to flow along a wall of a main body of the refrigerator, an ice making compartment formed in a door of the refrigerator, a cooling air passage formed at an outer surface of the ice making compartment to connect the ice making compartment with an end of the duct, and a screen selectively opening and closing the cooling air passage.

In a further another aspect of the present invention, there is provided a refrigerator including a main body having an opened side, a door selectively closing the opened side of the main body, an ice making compartment formed in the door, the ice making compartment being insulated from the outside and being kept at a low temperature, a duct formed in the main body for exchanging cooling air with the ice making compartment, a cooling air passage formed at an outer surface of the ice making compartment to connect the duct with the ice making compartment, a switching unit closing the cooling air passage when the door is opened and opening the cooling air passage when the door is closed, a restoring member restoring the switching unit to an original position, and a protrusion formed at an end of the duct to push the switching unit when the door is closed to open the cooling air passage.

According to the present invention, the cooling air can be supplied to the ice making compartment more smoothly and sufficiently. Also, cooling air leakage of the ice making compartment can be reduced in order to increase the ice making efficiency. In addition, penetration of foreign substances can be prevented in order to improve the quality of the ice produced at the ice making compartment.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Though a bottom freezer type refrigerator, in which a refrigeration chamber is located above a freezing chamber, is illustrated to describe the present invention, the present invention can be applied to various types of refrigerators as described previously. The present invention may be more effectively applied to a bottom freezer type refrigerator that has a large refrigeration chamber at an upper portion. Hereinafter, the term "refrigerator" will be used to denote a bottom freezer type refrigerator.

Figure 1:
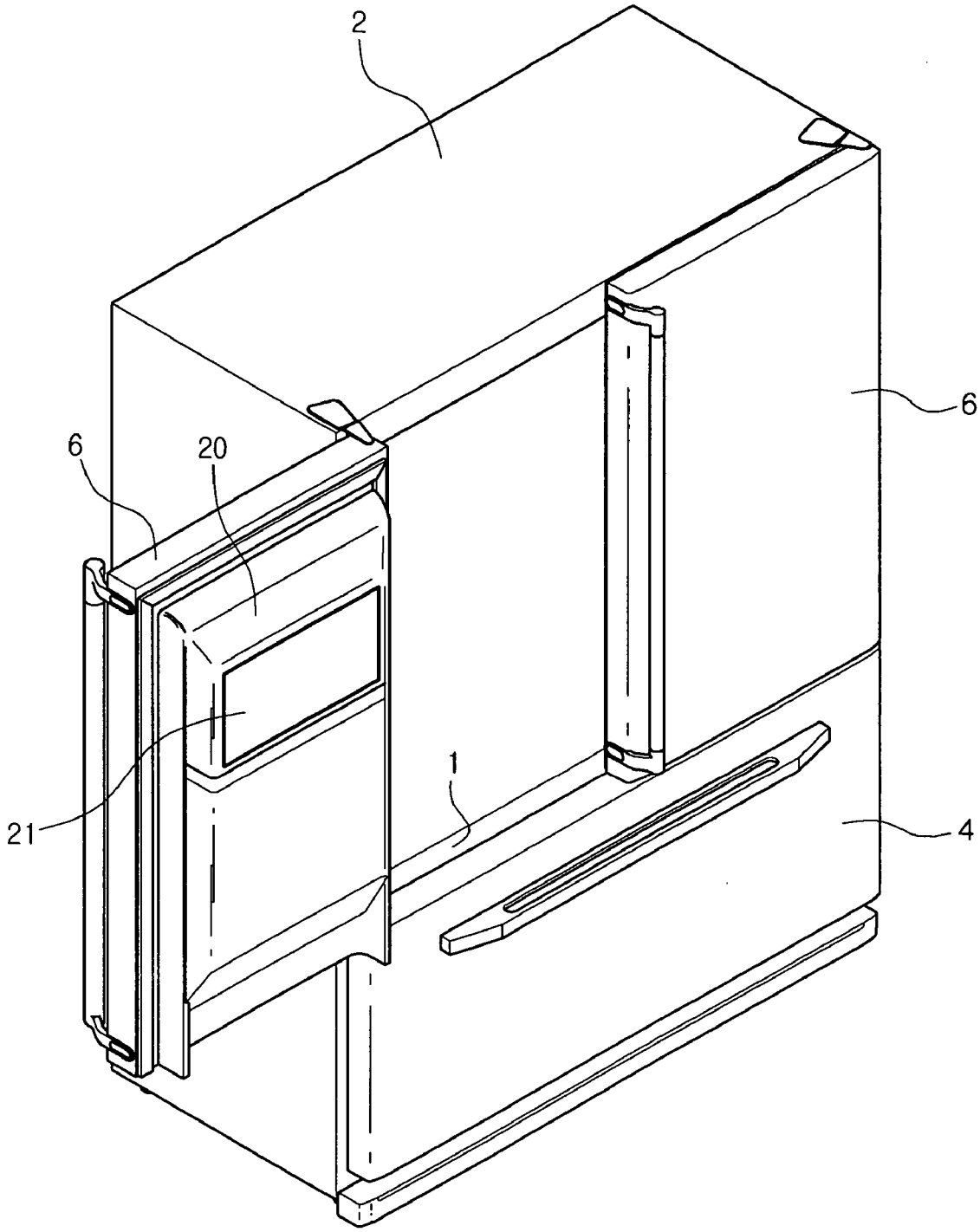
FIG. 1 is a perspective view of a refrigerator according to the present invention.
Figure 2:
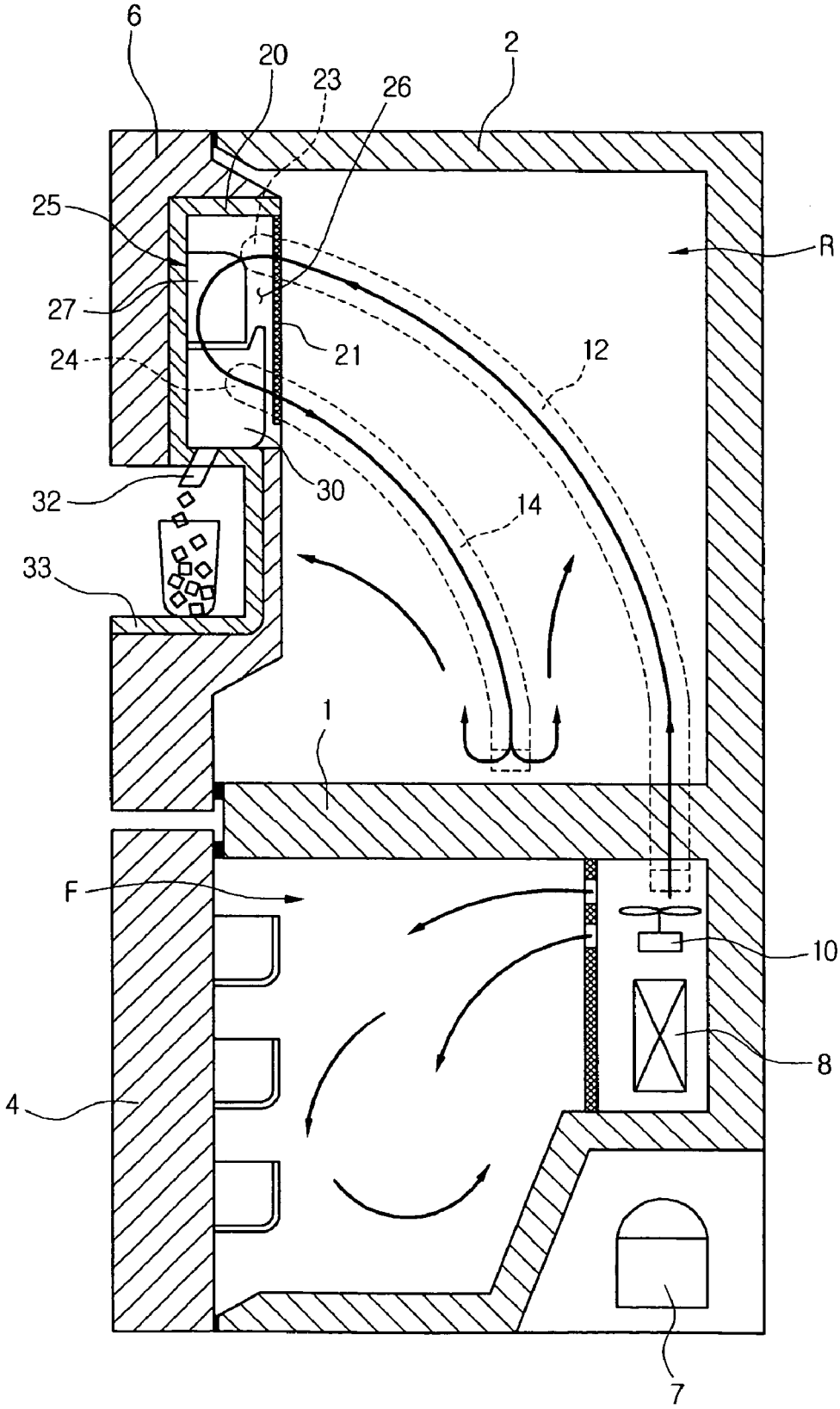
FIG. 2 is a side sectional view of a refrigerator according to the present invention.

Referring to FIGS. 1 and 2, a refrigerator includes a main body 2 in which a refrigeration chamber (R) and a freezing chamber (F) are partitioned on above the other by a barrier 1, a refrigeration chamber door 6 (two are shown) and a freezing chamber door 4 that are used to open and close the main body 2, an insulation case 20 inside the refrigeration chamber door 6 to define an insulated space, an ice making compartment 26 in the insulation case 20, an ice maker 27 installed in the ice making compartment 26 to freeze water with cooling air from the freezing chamber (F), an ice bank 30 storing the ice made at the ice maker 27, an ice outlet 32 and an ice dispenser 33 that are formed at a front of the refrigeration chamber door 6 to take out the ice from the ice bank 30 through a lever operation, and a compressor 7, a condenser (not shown), an expansion valve (not shown), and an evaporator 8 that are used in a refrigeration cycle to produce cooling air for the freezing and refrigeration chambers (F) and (R).

The insulated space inside the insulation case 20 is more securely insulated by the refrigeration chamber door 6 and an insulation door 21, and the insulated space forms the ice making compartment 26. The insulation case 20 and door 21 are made of insulating material, and they prevent the cooling air of the refrigeration chamber (R) from flowing into the ice making chamber 26 because the cooling air of the refrigeration chamber (R) is not cooler than the cooling air of the freezing chamber (F).

The insulation case 20 is installed between door liners. The insulation case 20 includes a cooling air inlet 23 at a side to receive cooling air and a cooling air outlet 24 at the same side to discharge the cooling air after use. The cooling air outlet 24 is provided to discharge the used cooling air back to the main body 2 through a discharge duct 14. Therefore, the cooling air outlet 24 may not be required when the ice making compartment 26 includes a discharge hole for discharging the used cooling air to the refrigeration chamber (R). Also, the discharge duct 14 may not be required in this case.

Further, the refrigerator includes a supply duct 12 in the barrier 1 and/or a sidewall of the main body 2. The supply duct 12 is connected with the cooling air inlet 23. The discharge duct 14 is connected with the cooling air outlet 24 to discharge the used cooling air from the ice making compartment 26 to the refrigeration chamber (R).

An operation of the refrigerator will now be described. In the refrigeration cycle of the refrigerator, the compressor 7 compresses a low-temperature, low-pressure refrigerant vapor to a high-temperature, high-pressure refrigerant vapor. The condenser condenses the compressed high-temperature, high-pressure refrigerant vapor to a high-pressure refrigerant liquid. The high-pressure refrigerant liquid as it passes through the expansion valve expands and then flows to the evaporator 8 where the refrigerant liquid evaporates. During the evaporation, the refrigerant liquid takes heat from surrounding air to change into a low-temperature, low-pressure refrigerant vapor. Thereafter, the low-temperature, low-pressure refrigerant vapor flows back to the compressor 7.

The air around the evaporator 8 is cooled during the evaporation of the refrigerant. A blower fan 10 installed adjacent to the evaporator 8 blows the cooled air (cooling air). A damper may direct the cooling air blown by the blower fan toward the freezing chamber (F) and the refrigeration chamber (R).

The cooling air is also directed to the ice making compartment 26 through the supply duct 12 and the cooling air inlet 23 of the insulation case 20. After the cooling air is circulated through the ice making compartment 26, the cooling air is discharged to the refrigeration chamber (R) through the cooling air outlet 24 of the insulation case 20 to decrease the temperature of the refrigeration chamber (R).

In the ice making compartment 26, the ice maker 27 of an ice making unit 25 freezes water using the cooling air. After the water is frozen in the ice maker 27, a heater (not shown) installed under a mold of the ice maker 27 is operated to separate the ice from the ice maker 27. The separated ice is stored in the ice bank 30. The stored ice may be crushed and discharged to the dispenser 33 through the ice outlet 32. The dispenser 33 is formed at a front of the refrigeration chamber door 6 with a recessed shape.

Figure 3:
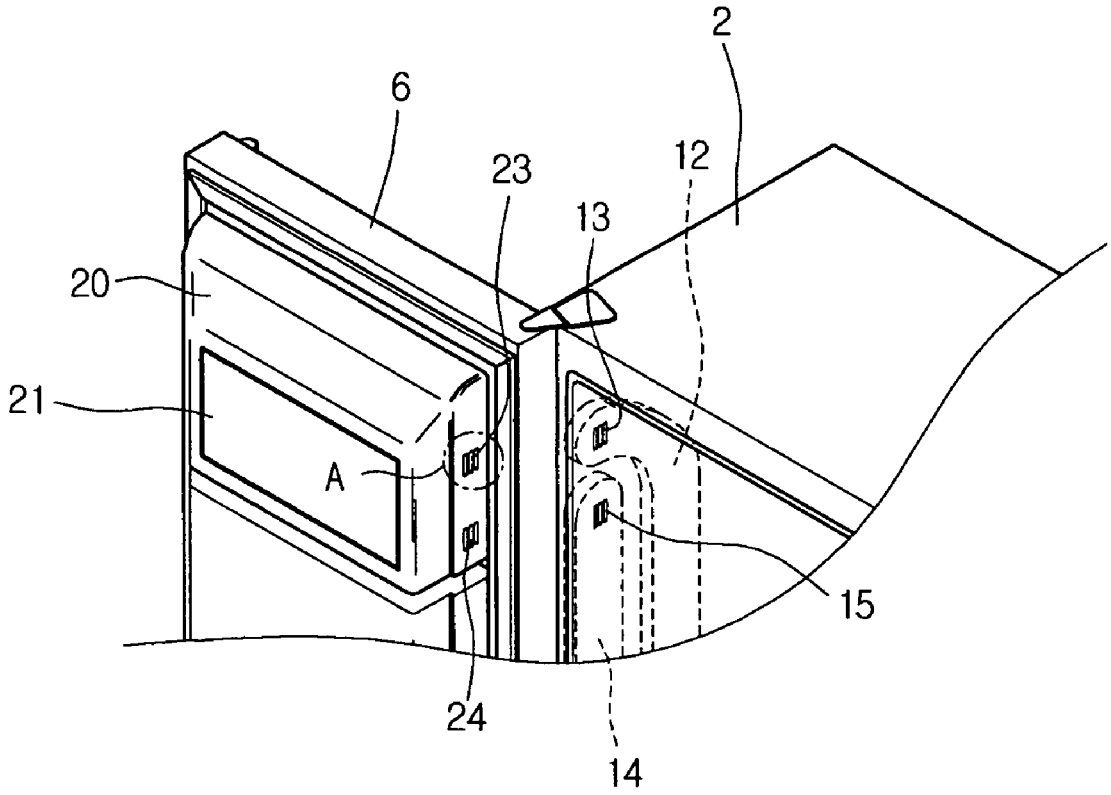
FIG. 3 is a partial perspective view of a refrigerator, showing a cooling air flow passage between an ice making compartment and a refrigerator body according to the present invention.

Referring now to FIG. 3, the cooling air inlet 23 and cooling air outlet 24 are located at predetermined portions of the ice making compartment 26. When the refrigeration chamber door 6 is closed, the cooling air inlet 23 comes into contact with a discharge end 13 of the supply duct 12, and the cooling air outlet 24 comes into contact with a suction end 15 of the discharge duct 14. That is, when the refrigeration chamber door 6 is closed, the cooling air is introduced to the ice making compartment 26 through the discharge end 13 and the cooling air inlet 23, and the cooling air is discharged from the ice making compartment 26 through the cooling air outlet 24 and a suction end 15.

Figure 4:
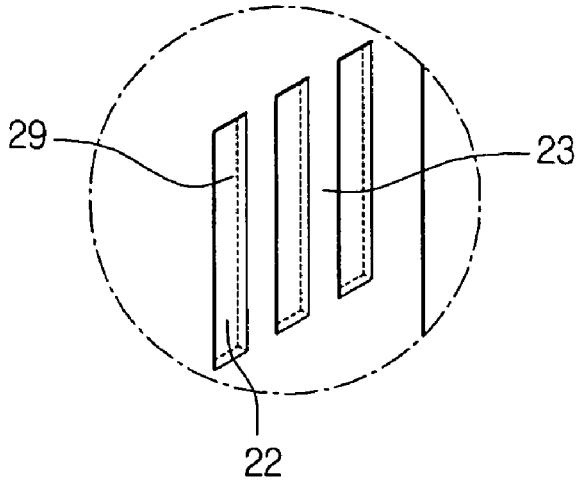
FIG. 4 is an enlarged view of a portion "A" in FIG. 3.

Each of the discharge end 13, cooling air inlet 23, cooling air outlet 24, and suction end 15 defines a plurality of slits (refer to 22 in FIG. 4) to pass the cooling air therethrough. Each of the slits 22 may be provided with a flexible screen (refer to 29 in FIG. 29). When the cooling air passes through the slits 22, the screens 29 deforms to allow the flow of the cooling air. When the cooling air does not pass through the slits 22, the screens 29 return to their original shape to close the slits 22. Since the screens 29 selectively open and close the slits 22, the screens may be referred to as a switching unit.

The screens 29 may be made of flexible rubber material and may include one or two ends fixed to the slits 22 and the other free ends. Therefore, the screens 29 can deform to open the slits 22 when the cooling air flows, and the screens 29 can return to their original shape to close the slits 22 when the cooling air does not flow. The relationship between the slits 22 and the screens 29 may be clearly understood with reference to FIG. 4, in which a portion "A" in FIG. 3 is enlarged.

In detail, when the refrigeration chamber door 6 is closed, the pressure of the cooling air opens the screen 29 to introduce the cooling air into the ice making compartment 26. When the refrigeration chamber door 6 is opened, the pressure of the cooling air disappears and the screen 29 is closed to block the slit 22. Therefore, the screen 29 can effectively prevent dissipation of the cooling air and penetration of foreign substances regardless of the number and size of the slit 22.

Though the screen structure is described with respect to the cooling air inlet 23, it is apparent to those of ordinary skill in the art that the screen structure can be easily applied to the cooling air outlet 24, suction end 15, and discharge end 13.

A refrigerator and an airflow passage for an ice making compartment of the refrigerator according to a second embodiment will now be made with reference to FIGS. 5 to 7. In this second embodiment, an exemplary structure and operation for restoring the switching unit to its original shape and position is described. Descriptions for the same parts as in the first embodiment may be similar or the same.

Figure 5:
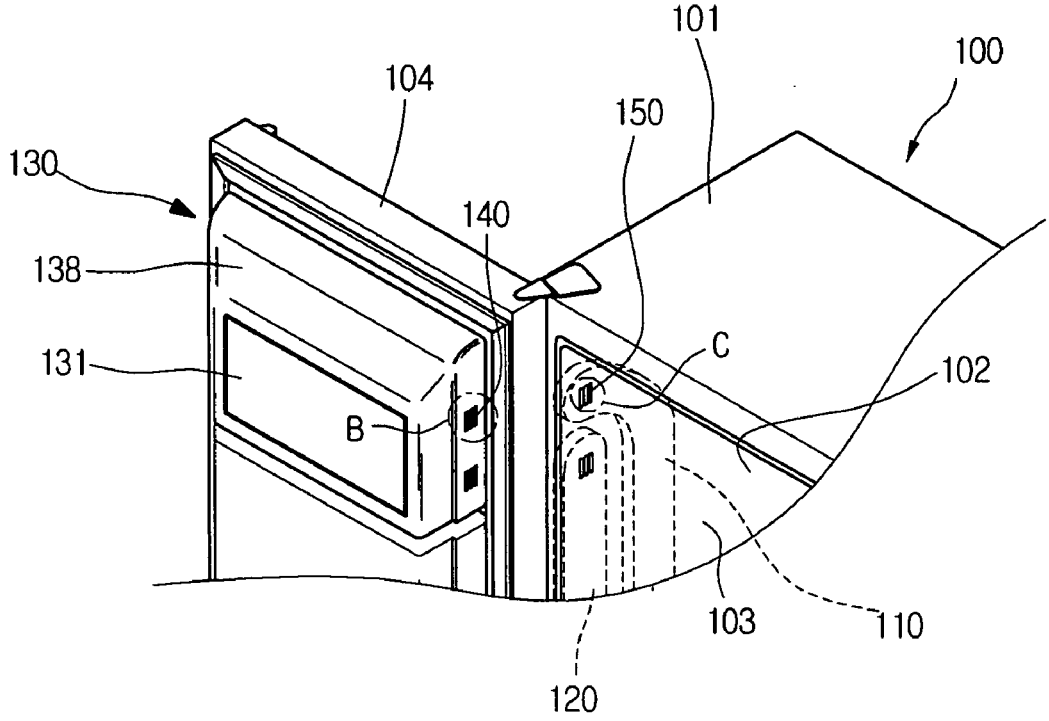
FIG. 5 is a partial perspective view of a refrigerator according to a second embodiment of the present invention.
Figure 6:
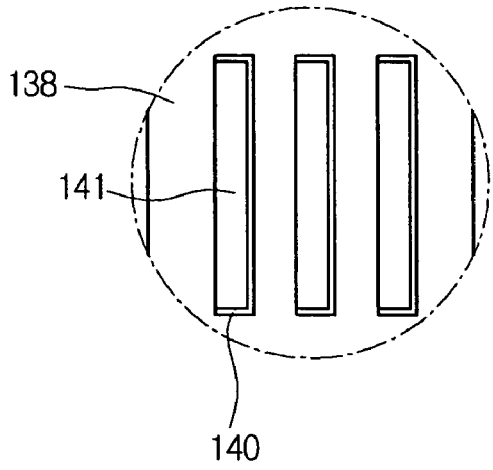
FIG. 6 is an enlarged view of a portion "B" in FIG. 5.
Figure 7:
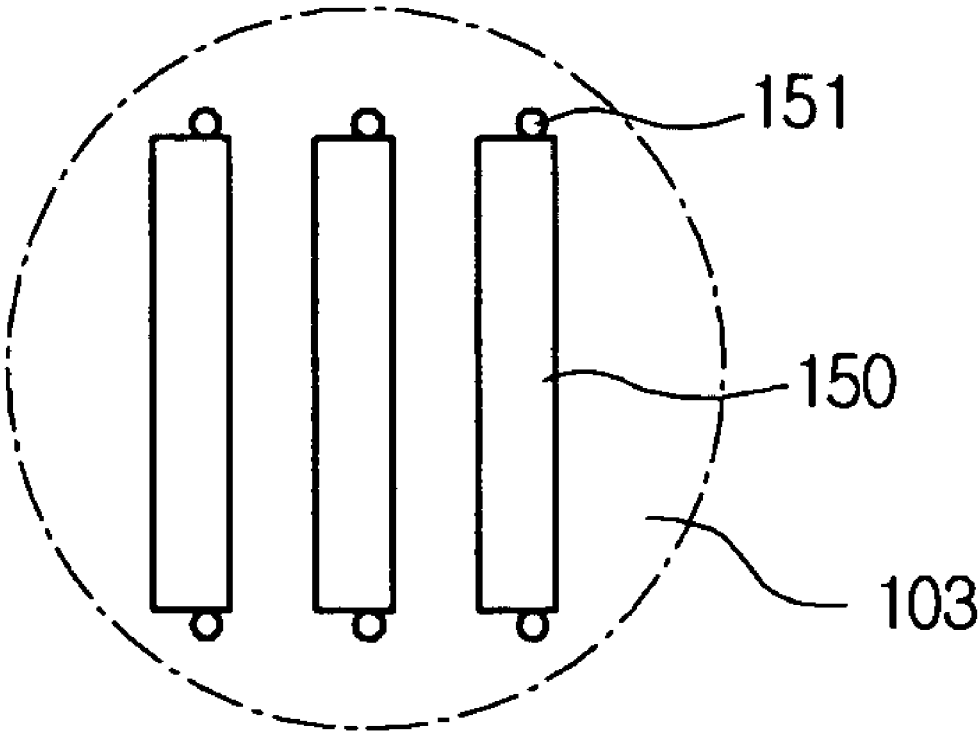
FIG. 7 is an enlarged view of a portion "C" in FIG. 5.
Figure 8:
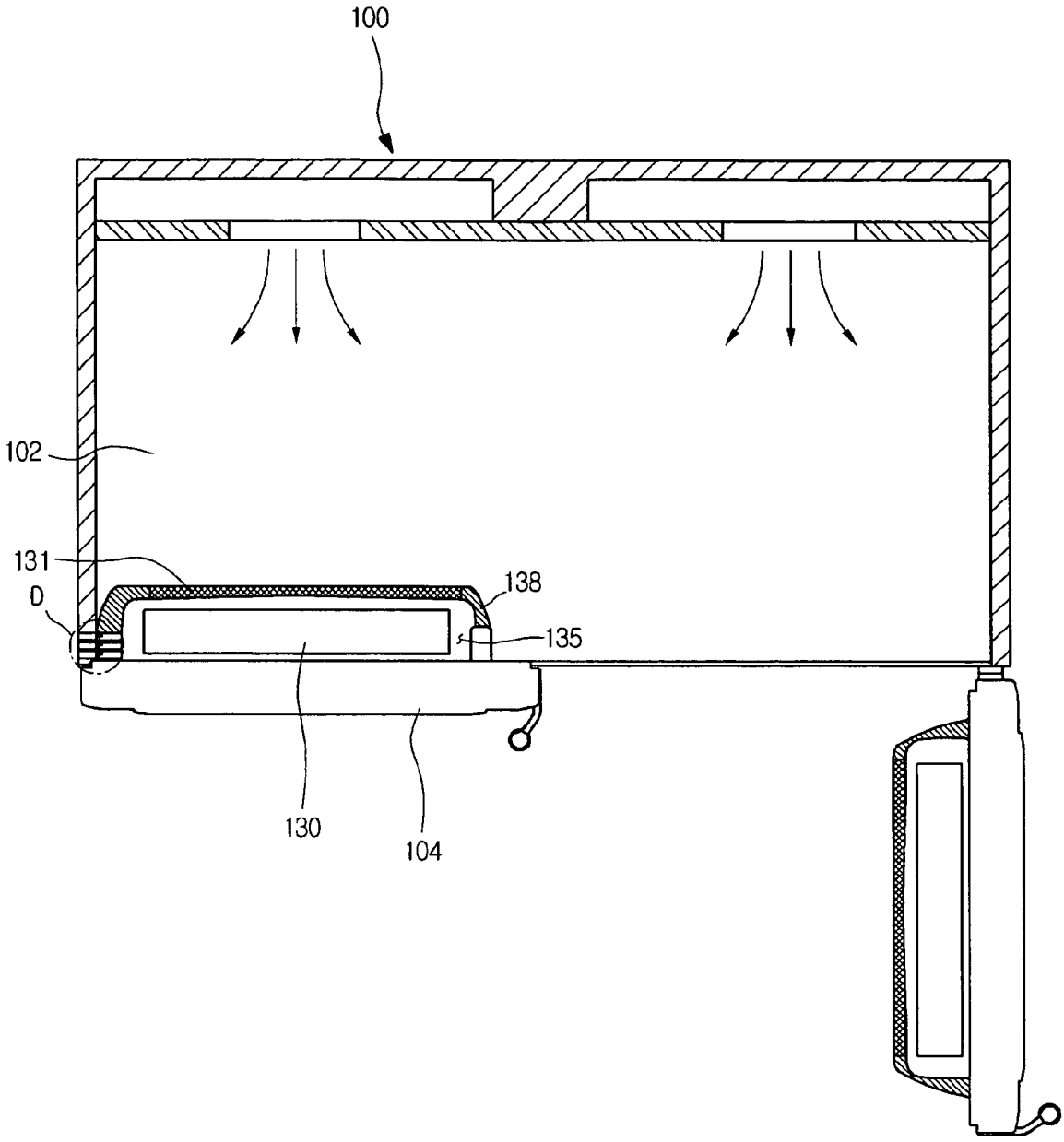
FIG. 8 is a cross sectional view of the refrigerator according to the second embodiment of the present invention.
Figure 9:
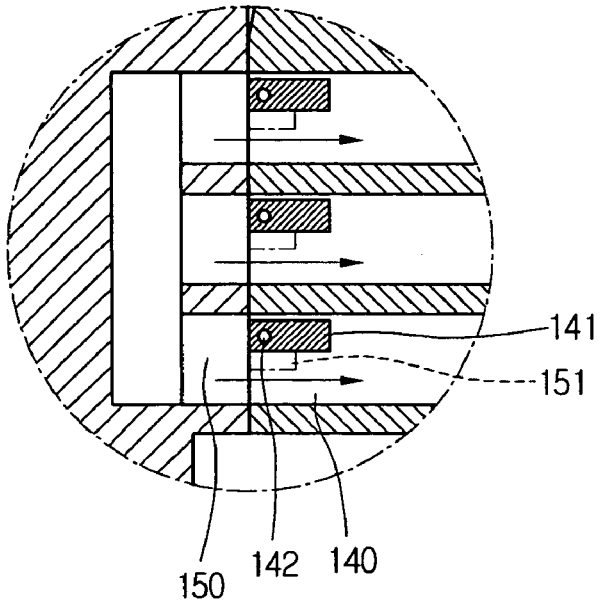
FIG. 9 is an enlarged view of a portion "D" in FIG. 8.
Figure 10:
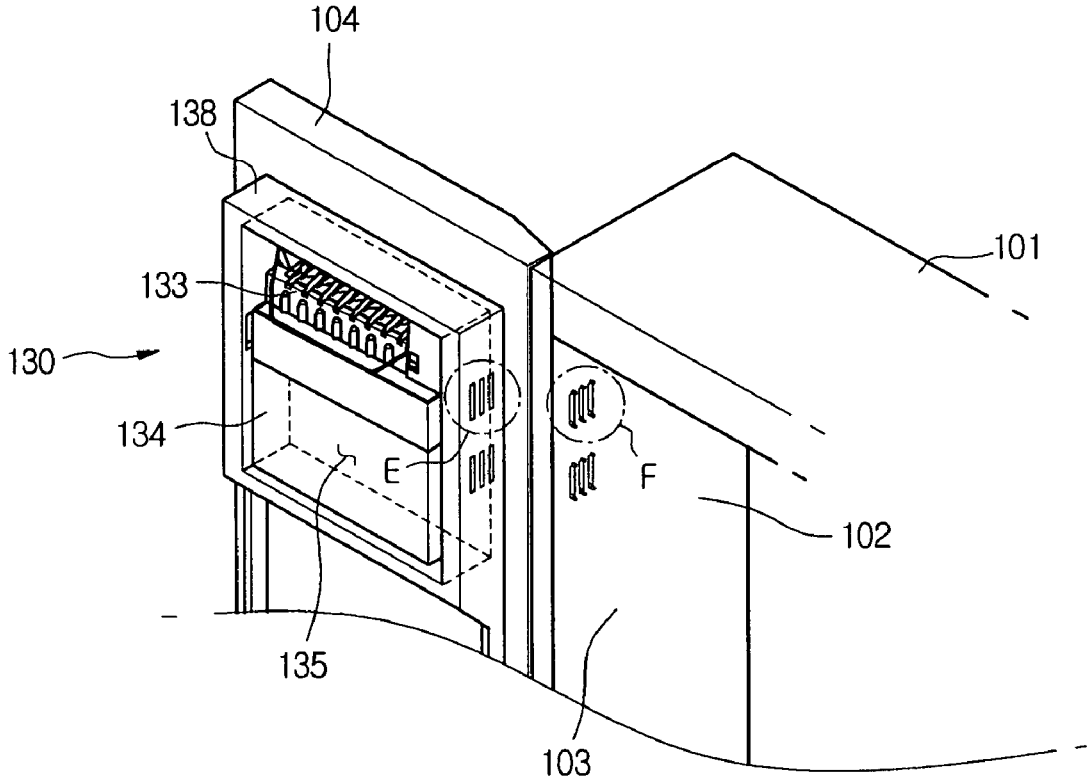
FIG. 10 shows a structure of an airflow passage for an ice making compartment when a refrigerator door is opened according to the second embodiment of the present invention.

Referring to FIGS. 5 to 7, a refrigerator 100 includes a refrigeration chamber door 104, an insulation door 131 and an insulation case 138 that form an insulated space in the refrigeration chamber door 104, an ice making compartment (refer to 135 in FIG. 8) formed in the insulated space, an ice making unit 130 in the ice making compartment 135, first slit portions 140 that are defined at one side of the insulation case 138 as a cooling air inlet and a cooling air outlet to introduce and discharge the cooling air, a switching unit 141 to open and close the first slit portions 140 according to the closing and opening of the refrigeration chamber door 104, a restoring member installed at the first slit portions 140 to support the switching unit 141 to keep a set position of the switching unit 141, second slit portions 150 that are defined at a sidewall 103 of the refrigeration chamber to respectively face with the first slit portions 140, the second slit portions 150 being defined at an suction end and a discharge end, and a pushing portion installed at the second slit portions 150 to open the switching unit when the refrigeration chamber door 104 is closed.

The refrigerator 100 also includes a suction duct 110 formed in a refrigerator wall to direct the cooling air to the ice making compartment 135, and a discharge duct 120 formed in the refrigerator wall to discharge the cooling air from the ice making compartment 135. The suction end is formed at an end of the suction duct 110, and the discharge end is formed at an end of the discharge duct 120.

An operation of the refrigerator and airflow passage for the ice making compartment will now be described. Referring to FIGS. 8 to 14, the ice making unit 130 is installed in the refrigeration chamber door 104 of the refrigerator 100, and the insulation door 131 and insulation case 138 are installed inside of the refrigeration chamber door 104 around the ice making unit 130 to insulate the ice making unit 130. That is, the insulation door 130 and insulation case 138 form the ice making compartment 135 in which the ice making unit 130 is installed.

The suction duct 110 is formed in a refrigerator sidewall and/or the barrier 1 to connect the evaporator and the ice making compartment 135 to supply cooling air from the evaporator to the ice making compartment 135. The cooling air is discharged through the discharge duct 120 after being circulated in the ice making compartment 135.

For this purpose, the insulation case 138 defines the first slit portions 140 at upper and lower sides. The cooling air is introduced, to the ice making compartment 135 through the upper slits and it is discharged through the lower slits. The second slit portions 150 corresponding to the first slit portions 140 are formed at both ends of the suction duct 110 and the discharge duct 120. The cooling air is supplied to the ice making compartment 135 through one of the second slit portions 150 formed at the end of the suction duct 110, and is discharged through the other one of the second slit portions 150 formed at the end of the discharge duct 120.

The flow of the cooling air for the ice making compartment 135 will now be more fully described. The first slit portions 140 are formed at one side of the insulation case 138. In other words, the first slit portions 140 are formed at upper and lower portions of a door liner. The second slit portions 150 are formed 103 at upper and lower portions of the sidewall 103 of the refrigeration chamber to face with the first slit portions 140.

The cooling air is supplied from the evaporator to the ice making compartment 135 through the upper slits of the second slit portions 150 and the upper slits of the first slit portions 140. After being circulated through the ice making compartment 135, the cooling air is discharged to the evaporator or the refrigeration chamber through the lower slits of the first slit portions 140 and the lower slits of the second slit portions 150.

The upper and lower slits of the first slit portions 140 are plural in number and uniformly arranged to form a circular or rectangular outline. The switching unit 141 is associated with the closing and opening of the refrigeration chamber door 104 to open and close the first slit portions 140. Also the pushing portion is installed adjacent to the second slit portions 150 to open and close the first slit portions 140 according to the closing and opening of the refrigeration chamber door 104.

The pushing portion pushes the switching unit 141 when the refrigeration chamber door 104 is closed to open the first slit portions 140. That is, the pushing portion and switching unit 141 are associated with each other in this relationship without other restriction therebetween.

Figure 11:
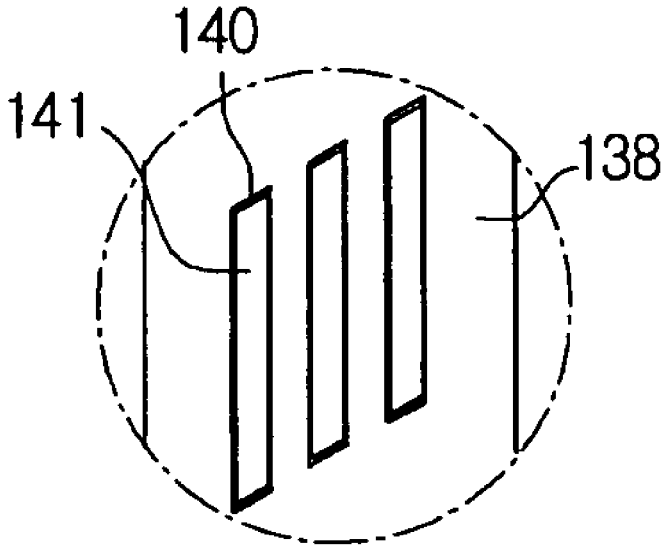
FIG. 11 is an enlarged view of a portion "E" in FIG. 10.
Figure 12:
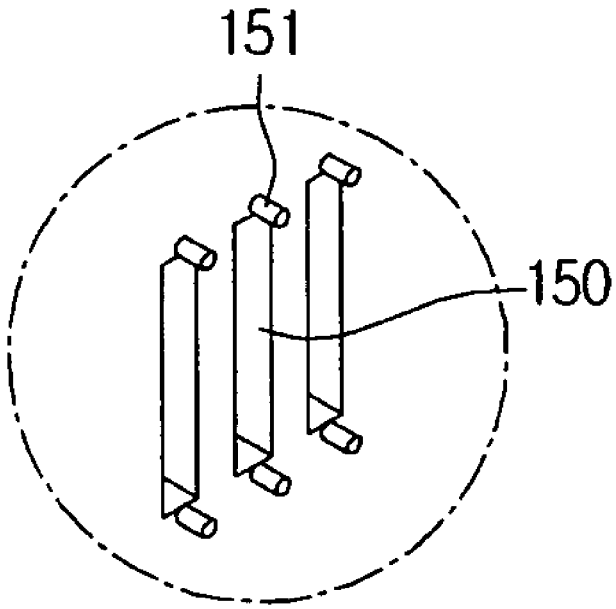
FIG. 12 is an enlarged view of a portion "F" in FIG. 10.
Figure 13:
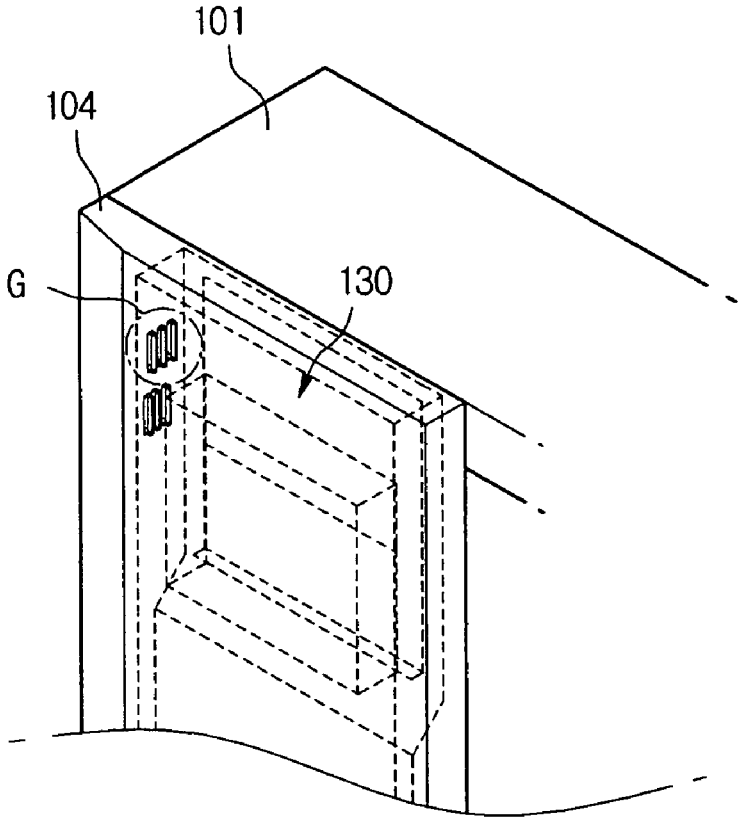
FIG. 13 shows a structure of an airflow passage for an ice making compartment when a refrigerator door is closed according to the second embodiment of the present invention.
Figure 14:
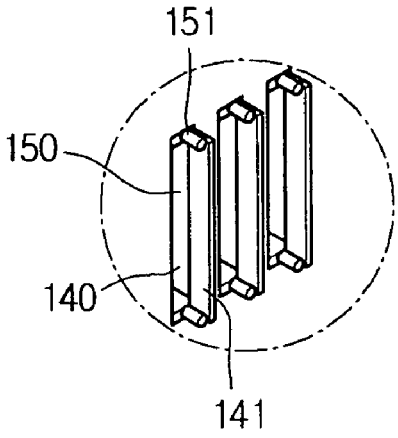
FIG. 14 is an enlarged view of a portion "G" in FIG. 13.

Referring to FIG. 11, screens are shown as an example of the switching unit. The screens 141 have a proper size and strength to cover the first slit portions 140. Referring to FIG. 12, the pushing portion may be protrusions 151 formed at upper and lower ends of the second slit portions 150. Though the slits of the first and second slit portions 140 and 150 may be the same sizes or different sizes, corresponding slits of the first and second slit portions may have the same sizes.

The screens 141 open the first slit portions 140 when the refrigeration chamber door 104 is closed, and the screens close the first slit portions 140 when the refrigeration chamber door 104 is opened to prevent penetration of foreign substances. The screens 141 may be rotatably fixed to the insulation case 138 using hinge shafts 142, and the screens may have proper stiffness to allow the protrusions 151 (pushing portion) to easily push them.

Since the protrusions 151 push the screens 141 when the refrigeration chamber door 104 is closed, the screens can be opened when the refrigeration chamber door 104 is closed. The protrusions 151 may be plural in number for each of the slits of the second slit portions 150 to smoothly push the screens 141. For example, two protrusions are formed at upper and lower portions of each slit of the second slit portions 150 in FIG. 9.

When the refrigeration chamber door 104 is opened, the cooling air in the ice making compartment 135, having higher pressure than atmospheric pressure, may be impulsively discharged through the first slit portions 140 to rotate the screens 141 to the closed position. Therefore, the closing operation of the screens 141 can be carried out when the refrigeration chamber door 104 is opened.

A third embodiment of the present invention will now be described with reference to FIGS. 15 and 16. In this third embodiment, restoring members are employed to restore the screens 141 (switching unit) to their original positions when the pushing actions of the protrusions 151 (pushing portion) are removed. Descriptions for the same parts as in the first embodiment or the second embodiment may be similar or the same.

Though the screens 141 are easily opened by the protrusions 151 when the refrigeration chamber door 104 is closed, the screens 141 may not be easily closed when the refrigeration chamber door 104 is opened because the pressure inside the ice making compartment 135 may not be enough to move the screens 141 to the closed positions. In other words, if the pressure inside the ice making compartment 135 is not sufficiently higher than the atmospheric pressure, the screens 141 may not close the first slit portions 140 when the refrigeration chamber door 104 is opened. Therefore, restoring members are employed in this embodiment to keep the screens 141 closed when an external force is not being applied to the screens 141.

Figure 15:
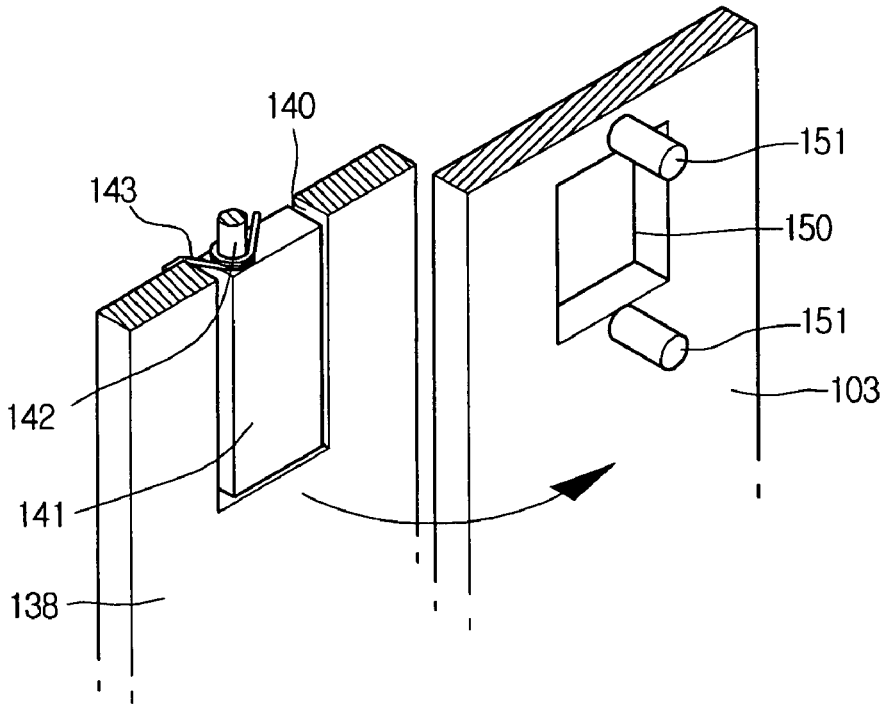
FIG. 15 is partial perspective view showing a structure of an airflow passage for an ice making compartment of a refrigerator when a refrigeration chamber door is opened according to a third embodiment of the present invention.
Figure 16:
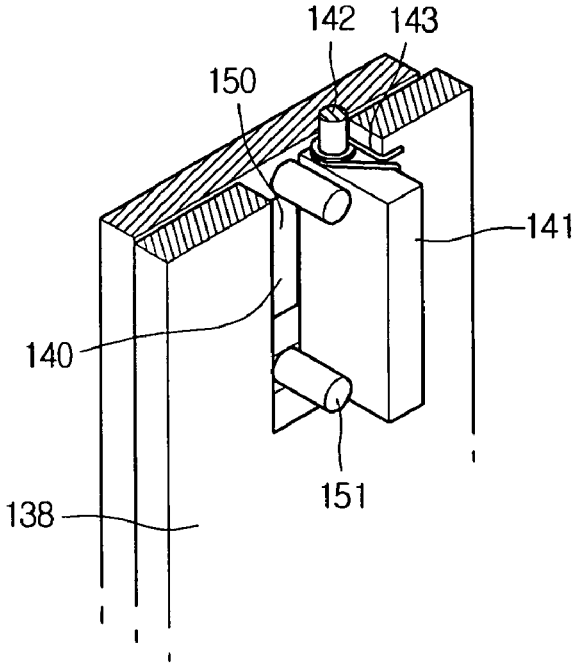
FIG. 16 is a partial perspective view showing a structure of an airflow passage for an ice making compartment of a refrigerator when a refrigeration chamber door is closed according to the third embodiment of the present invention.

Referring to FIGS. 15 and 16, a torsion spring 143 is associated with the screen 141 and the insulation case 138. The screen 141 is provided as an example of the switching unit to selectively open the slit of the first slit portions 140, and the hinge shaft 142 supports the rotation of the screen 141. The torsion spring 143 is provided as an example of the restoring member. The torsion spring 143 is wound around the hinge shaft 142 to restore the screen 140 to its closed position. Ends of the torsion spring 143 are respectively abutted on the screen 141 and the insulation case 138 to exert a restoring force to the screen 141.

The protrusions 151 are formed at upper and lower locations of the slit of the second slit portions 150. The slit of the second slit portions 150 is smaller than the slit of the first slit portions 140, such that the protrusion 151 can push the screen 141 through the slit of the first slit portions 140.

In operation, when the refrigeration chamber door 104 is opened (FIG. 15), the torsion spring 143 forces the screen 141 to close the slit of the first slit portions 140. A stopping portion may be formed at the screen 141 or the slit of the first slit portions 140 to align the screen which the slit of the first slit portions 140. If the torsion spring 143 is designed to have a small elastic modulus, the screen 141 returns to its closed position slowly.

When the refrigeration chamber door 104 is closed (FIG. 16), the protrusions 151 push the screen 141 to rotate the screen 141 about the hinge shaft 142 against the elastic force of the torsion spring 143. Therefore, the first and second slit portions 140 and 150 can be communicated with each other to supply the cooling air to the ice making compartment 135 and discharge the cooling air from the ice making compartment 135. An arrow in FIG. 15 indicates the closing direction of the refrigeration chamber door 104.

A fourth embodiment of the present invention will now be described with reference to FIGS. 17 and 18. In this fourth embodiment, another example of the restoring member is employed to restore the screen 141 (switching unit) to its original position when the pushing action of the protrusions 151 (pushing portion) is removed. Descriptions for the same parts as in the third embodiment may be similar or the same.

Figure 17:
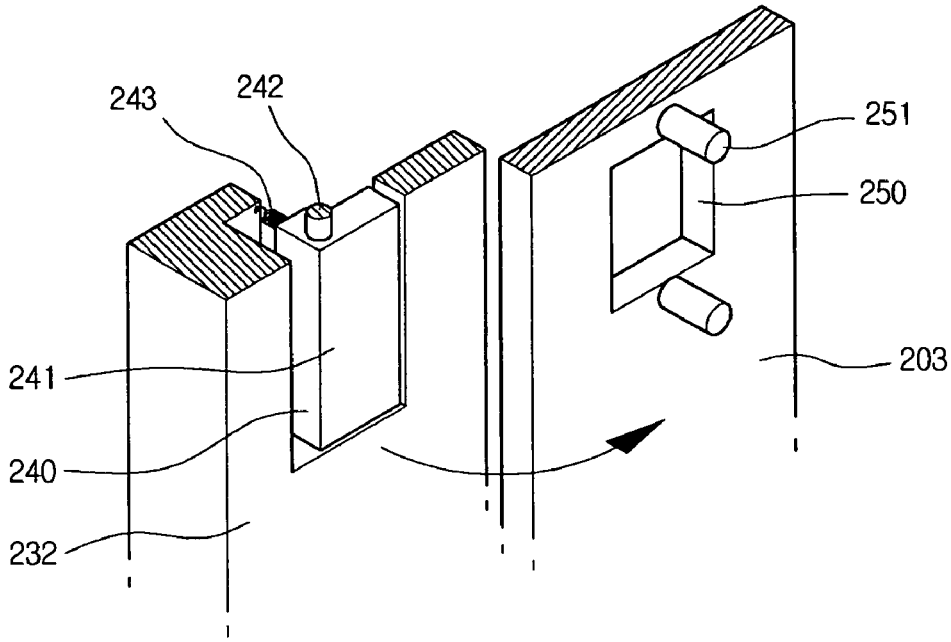
FIG. 17 is a partial perspective view showing a structure of an airflow passage for an ice making compartment of a refrigerator when a refrigeration chamber door is opened according to a fourth embodiment of the present invention.
Figure 18:
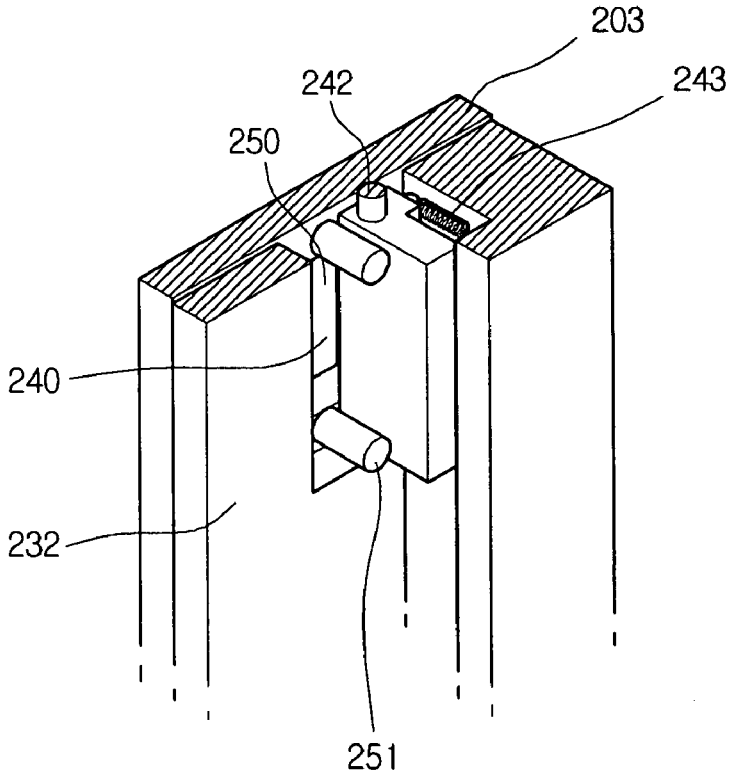
FIG. 18 is a partial perspective view showing a structure of an airflow passage for an ice making compartment of a refrigerator when a refrigeration chamber door is closed according to the fourth embodiment of the present invention.

Referring to FIGS. 17 and 18, an airflow passage includes an insulation case 232 in which an ice making compartment is defined, a first slit 240 defined in the insulation case 232, a switching unit such as a screen 241 that is disposed in the first slit 240 and is formed with a step at one side, a hinge shaft 242 supporting rotation of the screen 241, and a restoring member such as an extension spring 243 connected between the step of the screen 241 and the insulation case 232 to apply a restoring force to the screen 241.

The airflow passage also includes a second slit 250 and protrusions 251. The second slit 250 is defined in a sidewall 203 of the refrigeration chamber to pass cooling air therethrough, and the protrusions 251 are respectively formed at upper and lower portions of the second slit 250. The height of the second slit 250 is smaller than that of the first slit 240, such that the protrusion 251 can pass through the first slit 240. An arrow in FIG. 17 indicates the closing direction of the refrigeration chamber door.

In operation, when the refrigeration chamber door is opened (FIG. 17), the extension spring 243 forces the screen 241 to close the first slit 240. When the refrigeration chamber door is closed (FIG. 18), the protrusions 251 push the screen 241 to rotate the screen 241 about the hinge shaft 242 against the elastic force of the extension spring 243. Therefore, the first and second slits 240 and 250 can be communicated with each other to supply the cooling air to the ice making compartment and discharge the cooling air from the ice making compartment.

Torsion springs and extension springs, respectively used in the third and fourth embodiments, are exemplary ones for the restoring member. Other types of restoring members such as a compression spring can be used.

A fifth embodiment of the present invention will now be made with reference to FIGS. 19 and 20. In this fifth embodiment, another example of the pushing portion is employed to selectively open the screen (switching unit). Descriptions for the same parts as in the fourth embodiment may be similar or the same.

Figure 19:
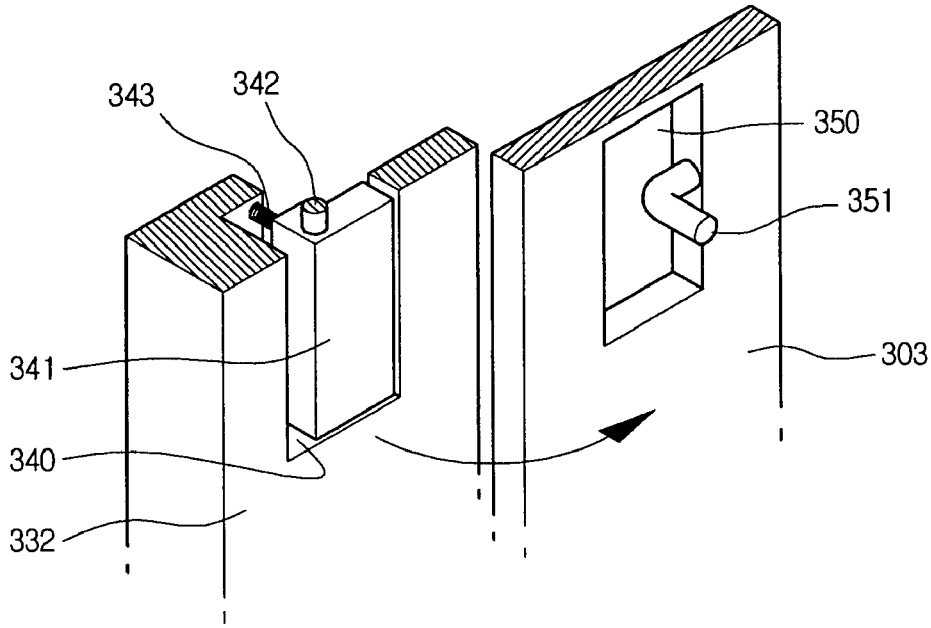
FIG. 19 is a partial perspective view showing a structure of an airflow passage for an ice making compartment of a refrigerator when a refrigeration chamber door is opened according to a fifth embodiment of the present invention.
Figure 20:
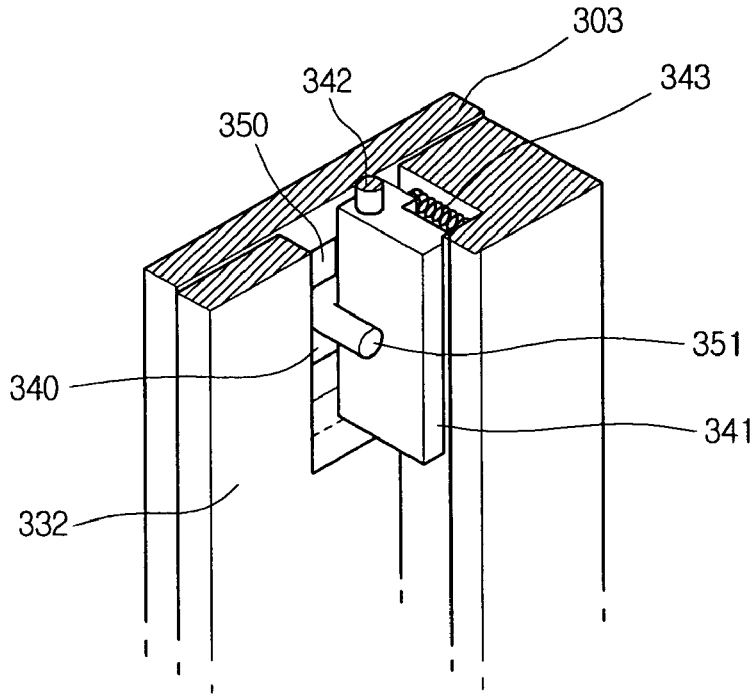
FIG. 20 is a partial perspective view showing a structure of an airflow passage for an ice making compartment of a refrigerator when a refrigeration chamber door is closed according to the fifth embodiment of the present invention.

Referring to FIGS. 19 and 20, an airflow passage includes an insulation case 332, a first slit 340 defined in the insulation case 332, a switching unit such as a screen 341 that is disposed in the first slit 340, a hinge shaft 342 supporting rotation of the screen 341, and a restoring member such as an extension spring 343 connected between the screen 341 and the insulation case 332 to apply a restoring force to the screen 341.

The airflow passage also includes a second slit 350 and a pushing portion such as a protrusion 351. The protrusion 351 is projected from an inner surface of the second slit 350 and is bent forward to protrude in a forward direction. Since the protrusion 351 is formed at the inner surface of the second slit 350 (that is, the protrusion 351 is formed within the height of the second slit 250), the first slit 340 and the second slit 350 can have the same height, thereby providing a wider passage for the cooling air.

In operation, when the refrigeration chamber door is opened (FIG. 19), the extension spring 343 forces the screen 341 to close the first slit 340. When the refrigeration chamber door is closed (FIG. 20), the protrusion 351 pushes the screen 341 at its center to rotate the screen 341 about the hinge shaft 342 against the elastic force of the extension spring 343. Therefore, the first and second slits 340 and 350 can be communicated with each other to supply the cooling air to the ice making compartment and discharge the cooling air from the ice making compartment.

A sixth embodiment of the present invention will now be described with reference to FIGS. 21 and 22. In this sixth embodiment, another examples of the slit, screen (switching unit), and protrusion (pushing portion) are described. Descriptions for the same parts as in the preceding embodiments may be similar or the same.

Figure 21:
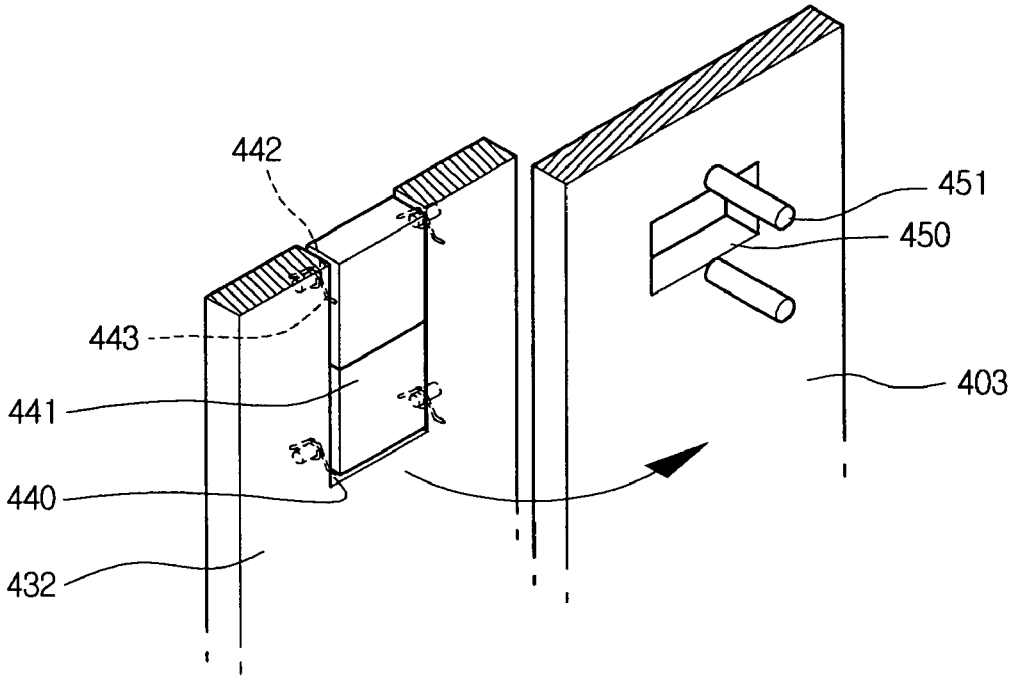
FIG. 21 is a partial perspective view showing a structure of an airflow passage for an ice making compartment of a refrigerator when a refrigeration chamber door is opened according to a sixth embodiment of the present invention.
Figure 22:
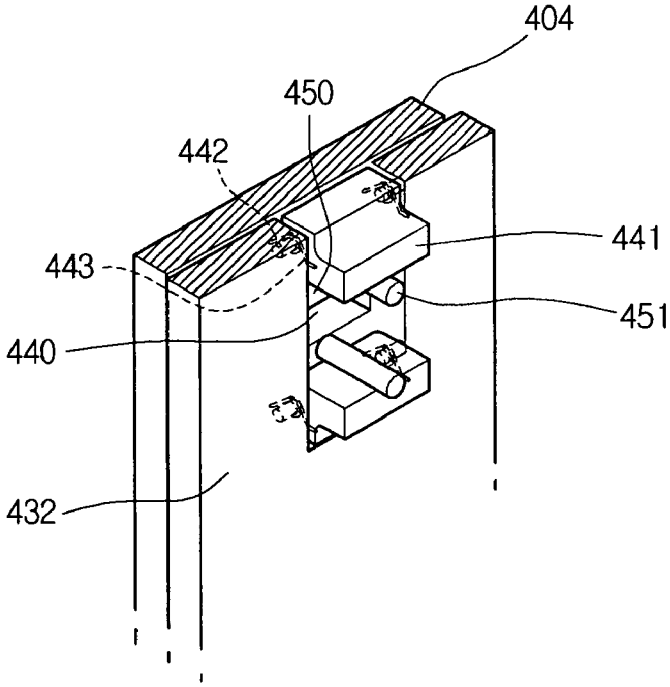
FIG. 22 is a partial perspective view showing a structure of an airflow passage for an ice making compartment of a refrigerator when a refrigeration chamber door is closed according to the sixth embodiment of the present invention.

Referring to FIGS. 21 and 22, an airflow passage includes an insulation case 432, a first slit 440 defined in the insulation case 432, a switching unit such as a plurality of screens 441 that are disposed in the first slit 440, hinge shafts 442 associated with the insulation case 432 in horizontal directions to support rotation of the screens 441, and a restoring member such as torsion springs 443. Each of the torsion springs 443 is wound around the hinge shaft 442 and abutted against the screen 441 and the insulation case 432 to apply a restoring force to the screens 441.

The airflow passage also includes a second slit 450 and a pushing portion such as protrusions 451. The protrusions 451 are projected forward from upper and lower center portions of the second slit 450. The screens 441 are two in number, more particularly, upper and lower ones that are aligned with the protrusions 451, respectively.

In operation, when the refrigeration chamber door is opened (FIG. 21), the torsion springs 443 force the screens 441 to close the first slit 440. When the refrigeration chamber door is closed (FIG. 22), the protrusions 451 push centers of the screens 441 to rotate the screens 341 about the hinge shafts 442 against the elastic force of the torsion springs 443. Therefore, the first and second slits 440 and 450 can be communicated with each other to supply the cooling air to the ice making compartment and discharge the cooling air from the ice making compartment.

The screens (switching unit) may be made of rubber material to slowly open and close the first slit. Also, the restoring member may have a lower elastic modulus when the screen is made of rubber material. In addition, the rubber screen may open the first slit widely because of its flexibility.

As described above, the bottom freezer type refrigerator, exemplarily selected to describe the present invention, includes the refrigeration chamber at an upper portion, the freezing chamber at a lower portion, and three doors (two for the refrigeration chamber and one for the freezing chamber). However, the present invention is not limited to the three-door bottom freezer type refrigerator. It is apparent to those of ordinary skill in the art that the present invention can be applied to various types of refrigerator such as a two-door bottom freezer type refrigerator, a top mount type refrigerator in which a freezing chamber and a refrigeration chamber are partitioned up and down, and a side-by-side type refrigerator in which a freezing chamber and a refrigeration chamber are partitioned left and right of one another.

According to the present invention, the switching unit is provided to selective open the slits of the ice making compartment. That is, the switching unit closes the slits when the refrigeration chamber door is opened, and the switching unit opens the slits when the refrigeration chamber door is closed to supply and discharge cooling air to the ice making compartment. Therefore, the cooling air can be sufficiently supplied to the ice making compartment without penetration of foreign substance into the ice making compartment.

Further, the restoring member and the pushing portion allow more reliable switching action of the switching unit, such that the user can conveniently use the refrigerator.

Although the present invention has been described with reference to utilizing an ice making compartment in the door of the refrigerator, it is to be understood that the switching unit described herein may be utilized with compartments in the door which are not intended for ice making, but which may be utilized as, for example, cold beverage compartments. In addition, the switching unit of the present invention is not limited to being used in a refrigerator, but may be utilized with any duct-to-door interface where closing of the duct is desired when the door is opened. For example, the switching units of the present invention may be used in an air duct system supplying conditioned air into an automobile door for subsequent distribution into the passenger compartment of the automobile.

The switching unit of the present invention may be part of the door or the compartment of the door which interfaces with the duct in the main body, or the switching unit may be associated with the duct in the main body which interfaces with the door or the compartment of the door. However, providing the switching unit with the compartment provides the most protection to the contents of the compartment against contamination from foreign materials.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A refrigerator comprising:

a main body having an open side;

a door for selectively closing the open side of the main body;

an ice making compartment formed in the door, the ice making compartment being insulated from outside and being kept at a low temperature;

a duct located in the main body for exchanging cooling air with the ice making compartment;

a cooling air passage formed in the ice making compartment to connect the duct with the ice making compartment; and a switching unit closing the cooling air passage when the door is opened and opening the cooling air passage when the door is closed.

2. The refrigerator according to claim 1, wherein the cooling air passage includes:

a cooling air inlet to receive the cooling air in the ice making compartment.

3. The refrigerator according to claim 1, wherein the cooling air passage includes:

a cooling air outlet to discharge the cooling air from the ice making compartment.

4. The refrigerator according to claim 1, wherein the cooling air passage includes a plurality of slits.

5. The refrigerator according to claim 1, wherein the duct is connected to a location where an evaporator of the refrigerator is installed.

6. The refrigerator according to claim 1, wherein the duct includes an end extended into a sidewall of the main body.

7. The refrigerator according to claim 1, wherein the duct includes an end shaped corresponding to the cooling air passage.

8. The refrigerator according to claim 1, wherein the switching unit includes a flexible screen having at least one end fixed to the cooling air passage.

9. The refrigerator according to claim 1, wherein the switching unit includes a screen, and the duct includes a pushing portion to push the screen open.

10. The refrigerator according to claim 1, wherein the switching unit includes a restoring member urging the switching unit to close the cooling air passage when an external force is not being applied to the switching unit.

11. The refrigerator according to claim 1, wherein the cooling air passage is formed at an insulation case forming the ice making compartment.

12. The refrigerator according to claim 1, wherein the door is a refrigeration chamber door.

13. The refrigerator according to claim 1, further comprising:

a restoring member restoring the switching unit to an original position; and a protrusion formed at an end of the duct to push the switching unit when the door is closed to open the cooling air passage.

14. The refrigerator according to claim 13, wherein the duct includes a suction duct and a discharge duct.

15. The refrigerator according to claim 13, wherein the cooling air passage includes a plurality of slits.

* * * * *